United States Patent [19]

Hanmer

[11] 4,426,272

[45] Jan. 17, 1984

[54] ELECTROLYTIC CELL VERMICULITE DIAPHRAGMS

[75] Inventor: Richard A. Hanmer, Lake Jackson, Tex.

[73] Assignee: The Dow Chemical Company, Midland, Mich.

[21] Appl. No.: 376,153

[22] Filed: May 10, 1982

Related U.S. Application Data

[63] Continuation of Ser. No. 182,914, Sep. 2, 1980, abandoned.

[51] Int. Cl.[3] ..... C25B 13/00

[52] U.S. Cl. ..... 204/296; 204/295; 429/252

[58] Field of Search ..... 204/296, 295; 429/247, 429/249, 252

[56] References Cited

U.S. PATENT DOCUMENTS

| | | | |
|---|---|---|---|
| 1,865,152 | 6/1932 | Stuart | 204/295 X |
| 3,944,477 | 3/1976 | Argade | 204/266 |
| 3,953,357 | 4/1976 | Preston et al. | 252/378 R |
| 4,036,729 | 7/1977 | Patil et al. | 204/296 |
| 4,207,163 | 6/1980 | Kadija | 204/253 |
| 4,233,379 | 11/1980 | Gross et al. | 429/247 |

*Primary Examiner*—F. Edmundson
*Attorney, Agent, or Firm*—W. J. Lee

[57] ABSTRACT

Diaphragms for use in electrolytic cells, e.g., chlor-alkali cells, are beneficially prepared using pulverized expanded vermiculite in place of the historically popular asbestos.

18 Claims, No Drawings

ELECTROLYTIC CELL VERMICULITE DIAPHRAGMS

This is a continuation of application Ser. No. 182,914 filed Sept. 2, 1980, now abandoned.

BACKGROUND OF THE INVENTION

It is a well known that various forms of asbestos, a mineral fiber, have been used for many years as diaphragm materials in various aqueous systems, especially chlor-alkali electrolytic cells. Ordinarily the diaphragms have been prepared by vacuum-drawing a slurry of asbestos fibers onto a porous cathode, thereby depositing a mat of asbestos on the cathode.

In recent years various polymer-bonded asbestos sheets and polymer-containing diaphragms have been prepared as shown by, e.g., U.S. Pat Nos. 3,017,338; 3,097,990; 3,153,610; 3,551,205; 3,583,891; 3,694,281; 3,704,221; 3,723,264; 3,505,200; 3,723,264; 3,853,720; 4,093,533; and 4,142,951. Other variations from the basic asbestos art are found in U.S. Pat. Nos. 4,036,729; 4,070,257; 4,081,350; and 4,126,535.

It is becoming increasingly desirable to find alternatives to the use of asbestos and this extends to uses in chemical processes, e.g., chlor-alkali electrolytic cells, especially diaphragm cells.

It has now been found that a suitable alternative to asbestos has been found in the use of pulverized expanded vermiculite as a diaphragm material in electrolytic cells. Whereas such pulverized expanded vermiculite structures are useful in other applications, this disclosure is particularly directed to such structures suitable for use in chlor-alkali electrolytic cells.

It has also been found that, in the making of diaphragms or membranes for chlor-alkali electrolytic cells, the expanded vermiculite requires additional treatment that is not required of asbestos, that is, the expanded vermiculite needs to be ground up (pulverized) to cause substantial separation of the platelets which comprise the expanded bundles; such pulverization causes a wide range of particle sizes which has been found to be a beneficial feature.

SUMMARY OF THE INVENTION

Diaphragms for chlor-alkali electrolytic cells are prepared from an aqueous slurry of pulverized expanded vermiculite (a naturally-occurring mineral of lamellar structure) by forming the desired diaphragm structure while de-watering, and substantially drying the structure. Optionally a chemically-resistant fibrous polymer can be included in the slurry mixture as a reinforcing agent for the final structure. Alternately, an optional bonding agent can be used with the vermiculite whether or not a fibrous reinforcing agent is included.

DETAILED DESCRIPTION OF THE INVENTION

Vermiculite is a naturally-occurring mineral of lamellar structure which is obtained by mining. It is a monoclinic hydrated magnesium silicate generally illustrated by the empirical formula $Mg_3Si_4O_{10}(OH)_2.xH_2O$. When heated quickly to about 250–300° C. vermiculite undergoes a rapid and large (up to 30 times original volume) expansion in a direction parallel to the C-axis, which is normal to the lamellar platelet structure. It is this expanded vermiculite which is ground-up (pulverized) for use in this invention. A convenient method for pulverizing the expanded vermiculite is by a cement mixer, mortar mixer, nip roller, hydropulper, or Waring blender, depending on what final average particle size is desired. Ordinarily, the vermiculite particles of greatest interest in the present invention will be of a size which, prior to being expanded, will pass through a 16-mesh screen (U.S. standard sieve size). If the particles are larger at the outset, it is recommended that they be reduced in size. Vermiculite particles which have been expanded at, say, 250–300° C. and then pulverized will generally have a wide range of resultant particle sizes from very fine up to several millimeters, depending on method and duration of pulverizing. For instance, a cement mixer pulverizer may give a range of particles where the largest sizes are on the order of about 3 mm in the greatest dimension; a hydropulper may give particles of about 1 mm and smaller; and a Waring blender may give particles of about 0.5 mm on down. The step of pulverizing breaks platelets apart from other platelets in the expanded lamellar structure and even breaks up platelets themselves. Ordinarily, and desirably, the platelet fragments after the pulverizing step have dimensions in the c-axis which are only $\frac{1}{2}$ or less the dimensions in the a-axis (normal to the c-axis).

As a binder for the vermiculite, if desired, one may use one of the water-soluble binders that exhibit low shrinkage upon drying, such as polyvinyl alcohol or an aliphatic resin copolymer, or even a dextrine/glycerol mixture. Alternatively one may optionally use a heat-bondable polymer which will become heat-plastified, or will at least heat-sinter. Various polyolefins may be employed, including olefins and diolefins which have organic or inorganic substituents; vinyl and acrylic type olefins are included. Preferably the polymer is a fluoropolymer in order to supply additional chemical resistance.

Some thermoplastic fluoropolymer latexes, such as polyvinylidene fluoride, have a negative surface charge in water; so does vermiculite. Hence in a slurry the two will repel each other and the plastic resists attaching to the vermiculite when heated to effect bonding. It has been found that when the slurry is acidified, preferably with HCl, the plastic will attach to the vermiculite.

The fluorocarbon polymer may be solid, particulate polymers or copolymers of tetrafluoroethylene, trifluoroethylene, or dichlorodifluoroethylene or may be fluorinated ethylene/propylene copolymer commonly known as FEP. Also, a copolymer of ethylene/chlorotrifluoroethylene known as Halar ® may be used. Preferably the fluorocarbon polymer is polyvinylidene fluoride, fluorinated ethylene/propylene copolymer, or polytetrafluoroethylene. Most preferably, the fluorocarbon polymer is polytetrafluoroethylene.

In a preferred embodiment of the present invention, pulverized expanded vermiculite is combined in aqueous slurry with a polymer, esp. a fluorocarbon polymer and the resulting slurry is deposited on a porous cathodic substrate. The polymer is then heat-sintered to add mechanical and chemical stability to the deposited mineral. The weight ratio of vermiculite/polymer is preferably in the range of about 20:1 to 1:1; most preferably the ratio is about 4:1.

The pregnant slurry may also contain minor amounts of processing aids such as surfactants, wetting agents, or dispersing agents, or modifiers, such as pH-adjusters, inorganic metal compounds, e.g., $TiO_2$, $CaCO_3$, MgO, CaO, etc. Such processing aids or modifiers may be employed in order to help disperse the polymer and the vermiculite uniformly in the aqueous medium and to impart certain porosity features to the diaphragm.

The polymer aqueous slurries or dispersions may be commercially available and generally contain such processing aids or modifiers as stabilizers, surfactants, dispersing agents, etc. Such polymer dispersions may also be prepared for use in the present invention by dispersing particulate or fibrous polymer in an aqueous medium by using wetting agents, surfactants, dispersing agents, or stabilizers which help to disperse the polymers and/or stabilize such dispersions.

The vermiculite and polymer slurry is preferably deposited on the desired porous cathode structure by being vacuum-drawn. By vacuum-drawn it is meant that a slurry of the diaphragm ingredients (vermiculite, polymer, modifiers, etc.) is contacted with one side of a porous cathode and "vacuum" (reduced pressure) is applied to the other side to pull the solids tightly into place against the cathode while pulling the liquid on through.

Other methods of depositing the diaphragm onto the cathode include the use of gravity flow or positive pressure to force the slurry against a porous surface, thereby depositing the solids in the form of a mat or web while the liquid flows on through the porous surface. The mat or web of diaphragm material may be prepared on a surface other than the cathode surface (such as by using a Fourdrinier process) and then transferred to the cathode surface.

In general, a preferred method of preparing embodiments of the present novel diaphragms for use in a chlor-alkali electrolytic process (wherein an aqueous NaCl solution is electrolyzed to produce chlorine, hydrogen, and sodium hydroxide) is as follows:

1. The pulverized expanded vermiculite and the fibrous and/or particulate polymers (esp. fluoropolymers) are intimately admixed and slurried in an aqueous medium. The aqueous slurry also contains any modifiers, surfactants, acidifiers, etc., which are desired. The total amount by weight of the combined polymer fibers and particles may be from about 0 parts to about 200 parts per hundred parts of total vermiculite, the preferred amount is about 5 to 100 parts with about 20 to 50 parts being most preferred. The polymer content may be in the form of fine particles, fibers, or a mixture of both. Preferably, the polymer content is substantially particulate rather than fibrous.

2. The slurried ingredients are deposited on the foraminous cathode to the desired weight, generally about 0.5 gms. to about 3.0 gms. per in.$^2$, and dried. Preferably, the weight is about 1 to about 2 gms./in.$^2$.

3. The so-coated cathode is subjected to a sufficient amount of heat to cause sintering or bonding of the polymer particles (when they are present in the mixture); pressure may be applied, if desired, either by placing a positive force against the diaphragm or by using a vacuum (reduced pressure) on the other side of the foraminous cathode which will draw the diaphragm tightly against the cathode during the sintering operation. The amount of heat will depend, to a large extent, on which polymer is being used; the sintering temperature (or softening temperature) of the desired polymer is easily determined experimentally or is available in publications. If no binder or fibers are used in the vermiculite, the need for heat-bonding is obviated and the diaphragm may be only de-watered, thereby forming a sheet.

4. The diaphragm-covered cathode is placed into position in the electrolytic cell and, in some cases, is "pre-wetted" by being soaked with a water-soluble wetting agent such as detergent, surfactant, methanol, or acetone to make the diaphragm less hydrophobic. Then it is generally flushed with water, anolyte, or brine after which the cell is filled with brine and is ready for the electrolytic process to begin. The "pre-wetting" is especially done for those polymeric fluorocarbons which exhibit a high degree of hydrophobicity or resistance to wetting, such as polytetrafluoroethylene.

In those cases in which relatively low bonding temperatures may be used, wetting agents present in the pregnant slurry may survive the bonding without appreciable degradation and may therefore aid in the initial "wetting-out" of the diaphragm when put into service in a chlor-alkali cell. When relatively high bonding temperatures are needed (such as with polytetrafluoroethylene) surfactants in the pregnant slurry may be thermally degraded and it may be advisable to employ a wetting agent or a "wetting-out" step for the diaphragm at the outset of its service in a chlor-alkali cell.

The electrolytic cell of special interest here is the diaphragm type commonly used for electrolysis of brine to produce chlorine, caustic, and hydrogen. Historically, the diaphragm has been made of asbestos, the anode has been made of graphite, and the cathode has been made of iron or steel. The diaphragm is positioned between the cathode and the anode and electric current flows through the electrolyte (brine). The porosity of the diaphragm is important in that there must be some water-permeability without having so much permeability that the caustic in the catholyte mixes freely with the anolyte. It is within the skill of practitioners of the chlorine cell art to adjust the porosity of asbestos diaphragms to obtain optimum results for their particular operation.

Other generalized procedures for preparing the novel vermiculite diaphragms of the present invention are enumerated as follows:

1. Cast a sheet of the pulverized expanded vermiculite from an aqueous dispersion, then de-water the sheet which, by careful handling, retains its contiguous sheet-like form;

2. Follow the procedure of (1) above, except that a fibrous polymer is included in the aqueous dispersion as a reinforcement means for the cast sheet of vermiculite;

3. Follow the procedure of (1) above, except that a binder is included in the aqueous dispersion as a means for strengthening the cast sheet of vermiculite;

4. Follow the procedure of (2) and (3) above simultaneously, thereby providing a bonding means and a fibrous reinforcement means in the cast sheet of vermiculite;

5. Provide a matter substrate of fibrous polymer to which is applied the aqueous dispersion of vermiculite, thereby depositing vermiculite onto, and within, the fibrous mat;

6. Follow the procedure of (5) above, except that a binder is included in the aqueous dispersion of vermiculite;

7. Follow the procedure of (1) through (6) above, but with the additional step of calendering, pressing, or heat-bonding to improve the physical integrity of the vermiculite sheet.

In chlor-alkali cells which employ pocket-cathodes, the historically-popular technique of vacuum-drawing the membrane directly onto the foraminous cathode is conveniently employed. In cells which use cathode plates, the diaphragm may be applied directly to the cathode, but it may be more convenient to prepare the diaphragm on a screen, a foraminous substrate, or a Fourdrinier machine and then affix the diaphragm in position in the cell between cathode and anode.

EXAMPLE 1

An aqueous slurry of 16 weight percent expanded vermiculite is worked extensively under low-shear conditions, as for example, 24 hours in a common cement mixer. The resulting slurry is contacted with a foraminous surface, such as a metal cathode assembly, under a vacuum of about 2–5 inches of mercury for a brief period of time such as 15 seconds. (Generally in the industry, foraminous metal cathode assemblies have holes of a size of about 0.1 inch.) The deposited slurry, when dried, is found to weigh about 1.6 grams per square inch of foraminous surface. The diaphragm so formed may be fragile, but can be assembled while still moist into a chlor-alkali cell. Optionally, a soluble binder such as polyvinyl alcohol or aliphatic resin co-polymer can be added in order to strengthen the diaphragm after it is formed and dried. The diaphragm is then allowed to dry in air or under moderate heat.

If a thinner diaphragm is desired with the same solids content per unit area of foraminous surface, the slurry can be classified. In order to be classified, the same 16 weight percent slurry which has been worked under the same low-shear conditions is diluted under agitation with water so that the mineral is separated into floating and sinking fractions. The sinking particles are allowed to settle thoroughly. The floating particles, along with the supernatent water, are skimmed off and discarded. If enough of the water has been removed in the classifying step, the slurry may then be thoroughly stirred and the diaphragm formed as above, with the soluble binders optional. If insufficient water has been removed, the sinking particles will be seen to segregate into layers of differing sizes. In this case enough electrolyte is dissolved in the slurry to flocculate the sunken vermiculite fraction into a homogeneous viscuous fluid. Any electrolyte will effect such flocculation, but sodium carbonate is preferred because of its non-corrosive properties. The flocculated slurry is then formed into a diaphragm according to the above procedure, with the soluble binders similarly optional. In a laboratory cell the resulting diaphragm yields 100 grams per liter caustic soda at a current density of 0.5 amps per square inch and with a separator efficiency of over 95%.

EXAMPLE 2

Up to 60% by weight of a thermoplastic fluoropolymer binder, in the form of a powder or a dispersion, is added to the simple slurry, the classified slurry, or the classified and flocculated slurry of Example 1. If a latex is used, the plastic will attach to the vermiculite if the pH of the slurry is lowered to about 3 or below with, e.g., HCl. (The soluble binder is optional and may be omitted.) A stabilizer or plasticizer, such as glycerol or ethylene glycol, may be optionally added to control shrinkage during drying and sintering. The diaphragm is then formed as in Example 1, and after drying is heat-sintered at the melting temperature of the fluorocarbon polymer. In a laboratory cell, the diaphragm so-formed operated at a separator efficiency of over 93% and at a caustic strength of 114 grams per liter NaOH.

EXAMPLE 3

The finished prepared slurries of Examples 1 and 2 may, in addition, be combined with up to 33% by weight of fluorocarbon polymer fibers to effect further mechanical stability. A stabilizer or plasticizer is generally not needed when there is appreciable fiber content. In a laboratory cell, such diaphragms show a separator efficiency of between 91 and 94 percent at a caustic strength of about 105 grams per liter NaOH.

EXAMPLE 4

An aqueous slurry of 12 weight percent vermiculite is worked under medium-shear conditions, as for example, 2 hours in a commercial hydropulper. Unlike the previous examples, fluorocarbon polymer fibers (or the like) must be present to bridge the holes in the foraminous surface, as the unflocculated particles are too small to do so by themselves. From 4 to 40 weight percent fibers are added to the slurry, which, however, may still be optionally flocculated as in Example 1. The diaphragm, formed as in Example 1, may also be optionally strengthened by soluble binders as in Example 1 or up to 60% by weight of a thermoplastic fluoropolymer binder as in Example 2. Stabilizers or plasticizers are optional. A large laboratory cell with a diaphragm so formed showed a separator efficiency of over 95% at a caustic strength of 104 grams per liter NaOH.

EXAMPLE 5

An aqueous slurry of 9 weight percent vermiculite is worked under high-shear conditions, as for example, 3 minutes in a Waring Commercial blender at "low" setting. All of the techniques and options of Example 4 apply, except that the lower limit of fluorocarbon polymer fibers is preferably raised to 8 percent by weight. In a laboratory cell a diaphragm so-formed ran for over a year with a separator efficiency of over 90%.

EXAMPLE 6

A diaphragm is produced using vermiculite, TFE, Teflon fibers and FEP Teflon dispersion. The slurry is refined in the hydropulper with water until the largest vermiculite particles are about 1 mm in diameter.

The slurry has the consistency of latex house paint and is applied to the cathode with a paint spray gun. A total of 1219 g of solids is sprayed on a 1100 sq. in., 500 amp, two pocket cathode. The diaphragm appears to be uniform in thickness but may have some pin holes created by the vacuum used to de-water the diaphragm before drying. The diaphragm is bonded at 550° F. for an hour. The initial flow is high and start-up gpl low, at 25.2 gpl. Start-up voltage is a little high but comes down to 3.0 V after about four hours. After awhile the caustic strength lines out at about 120 gpl and the voltage lines out at 2.91 for 0.4 asi current density.

I claim:

1. A semi-permeable material for use as a hydraulically-permeable diaphragm in an electrolytic cell, said material consisting essentially of a contiguous sheet of pulverized expanded vermiculite deposited on a foraminous cathode.

2. The contiguous sheet of claim 1 when positioned as a diaphragm in a chlor-alkali cell.

3. The contiguous sheet of claim 1 wherein the vermiculite comprises particles which prior to being expanded and then pulverized, are of a size not greater than about 16-mesh, U.S. Standard sieve size.

4. The contiguous sheet of claim 1 wherein there is incorporated therein a minor amount of fibrous polymer reinforcement.

5. The contiguous sheet of claim 1 wherein there is incorporated therein a minor amount of particulate polymer binder.

6. The contiguous sheet of claim 1 wherein there is incorporated therein a minor amount of fibrous polymer reinforcement and a minor amount of particulate polymer binder.

7. The contiguous sheet of claim 4 wherein the fibrous polymer comprises a fluoropolymer.

8. The contiguous sheet of claim 5 wherein the polymer binder comprises a fluoropolymer.

9. A method for preparing a vermiculite sheet material for use as a diaphragm means in an electrolytic chlorine cell, said method comprising expanding vermiculite particles which are of a size not greater than about 16-mesh, U.S. Standard Seive Size, pulverizing said expanded vermiculite particles, preparing an aqueous dispersion of said pulverized particles, and formng a substantially de-watered, contiguous, diaphragm sheet material from said aqueous dispersion onto a foraminous cathode.

10. The method of claim 9 wherein the aqueous dispersion of vermiculite particles contains a minor amount of binder means for the particles.

11. The method of claim 10 wherein the binder means comprises a polymer.

12. The method of claim 11 wherein the polymer is a fluoropolymer.

13. The method of claim 9 wherein the aqueous dispersion of vermiculite particles contains a minor amount of fibrous material.

14. The method of claim 13 wherein the fibrous material comprises polymer fibers.

15. The method of claim 14 wherein the polymer is a fluoropolymer.

16. The method of claim 9 wherein the aqueous dispersion of vermiculite particles contains a minor amount of binder means a minor amount of fibrous material.

17. The method of claim 16 wherein the binder means and the fibrous material are comprised of polymers.

18. The method of claim 17 wherein the polymers are comprised of fluoropolymers.

* * * * *

UNITED STATES PATENT AND TRADEMARK OFFICE

CERTIFICATE OF CORRECTION

PATENT NO. : 4,426,272

DATED : January 17, 1984

INVENTOR(S) : Richard A. Hanmer

It is certified that error appears in the above—identified patent and that said Letters Patent is hereby corrected as shown below:

Col. 1, line 9 delete the first occurance of "a".
Col. 2, line 44 "polymer" should be --polymers--.
Col. 4, line 55 "matter" should be --matted--.
Col. 8, line 1 "formng" should be --forming--.
Col. 8, line 20 insert --and-- after "means".

Signed and Sealed this

*Fifth* Day of *June 1984*

[SEAL]

*Attest:*

GERALD J. MOSSINGHOFF

*Attesting Officer*

*Commissioner of Patents and Trademarks*